10/15/85 OR 4,546,562

United States Patent [19]

Jones

[11] Patent Number: 4,546,562

[45] Date of Patent: Oct. 15, 1985

[54] ANIMATED TOY

[76] Inventor: Gregory A. Jones, 1940 Webb, Detroit, Mich. 48206

[21] Appl. No.: 483,096

[22] Filed: Apr. 8, 1983

[51] Int. Cl.[4] ..... G09F 19/08; A63H 13/00

[52] U.S. Cl. ..... 40/591; 40/422; 446/201; 446/391

[58] Field of Search ..... 46/44, 53, 55, 56, 57, 46/157, 58, 221; 40/412, 413, 418, 420, 422, 439, 440, 613, 591; 446/176, 199, 201

[56] References Cited

U.S. PATENT DOCUMENTS

| | | | |
|---|---|---|---|
| 1,547,870 | 7/1925 | Green | 46/221 |
| 2,025,295 | 12/1935 | McCully | 46/157 |
| 2,573,625 | 10/1951 | Swart | 40/422 |

FOREIGN PATENT DOCUMENTS

| | | | |
|---|---|---|---|
| 597577 | 5/1960 | Canada | 46/55 |
| 581868 | 10/1924 | France | 40/420 |

*Primary Examiner*—F. Barry Shay

*Attorney, Agent, or Firm*—Dale R. Small & Associates

[57] ABSTRACT

An animated toy for use in conjunction with a vehicle comprising a body member having a pictorial representation of the upper body of a runner thereon, a leg member including plural leg portions resistant to air passing thereby pivotally mounted on the base member adjacent the pictorial representation of the upper body portion of the runner for providing the illusion of the runner running on rotation of the leg member due to air passing the leg member and means for mounting the animated toy on the vehicle on closing of the vehicle window on a support member for the toy.

6 Claims, 10 Drawing Figures

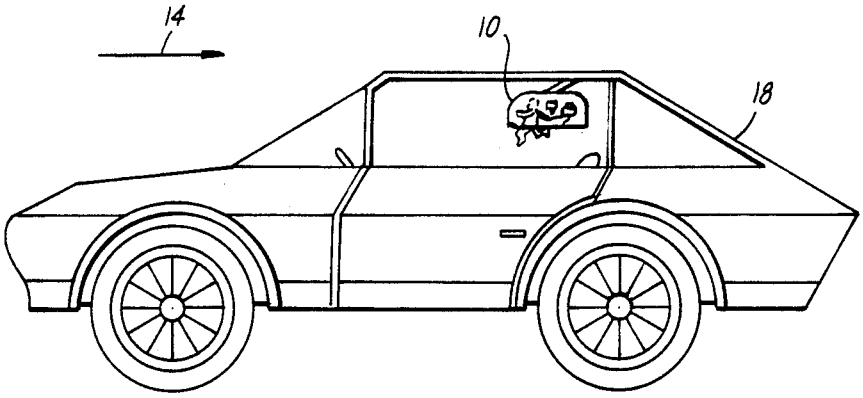
FIG. 1
FIG. 2
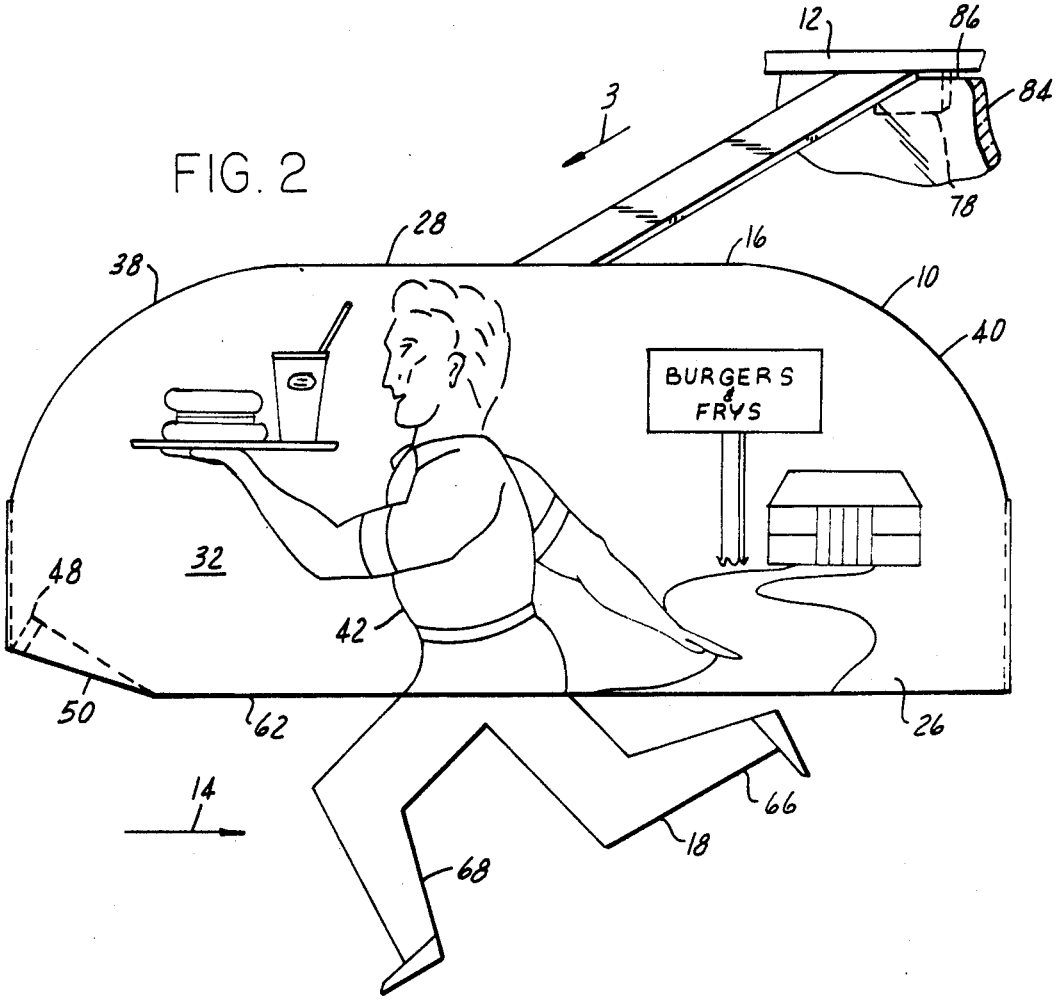

ANIMATED TOY

BACKGROUND OF THE INVENTION

1. Field of the Invention

The invention relates to toys and refers more specifically to an animated toy in the form of a runner for use in conjunction with an automobile or other vehicle whereby air passing the moving vehicle provides motive force for the animation of the toy.

2. Description of the Prior Art

Many prior art toys are not animated, that is, they have no moving parts or at least the moving parts are movable only manually. Thus, for example, arms, legs, and heads of dolls may move only on being grasped and physically moved relative to the remainder of the doll. Toy trucks are moved only by manually giving them a push.

Where toys in the past have been animated they have usually required an exterior energy source which is sometimes expensive and usually has to be replenished. Thus, the many animated toys operated by storage batteries and the like are well known.

Where animated toys of the past have been provided which do not need to be manually actuated or which depend on natural phenomena for their animation such as pin wheels and the like, they have not been sufficiently related to every day characters and physical objects within the knowledge of children utilizing such toys to provide adequate interest for the children.

SUMMARY OF THE INVENTION

In accordance with the invention, an animated toy is provided which utilizes air passing a moving vehicle as the motive force therefor. In particular, the toy may be a pictorial representation of a runner, the legs of which runner are rotatably mounted for movement by air passing a vehicle to give the illusion of the runner actually running with the vehicle. The toy is particularly suited for promotion of fast food chains, oil company gasoline stations, trademarked clothes such as athletic shoes, and the like.

More specifically, the invention is animated toy structure including a body member consisting of two flat sheets with flat surfaces in juxtaposition, with the top and two ends thereof secured together and with bottoms which are readily spread apart which body member has a picture of the upper body of a runner thereon. The animated toy structure further includes a leg member having a plurality of leg portions thereon and axle structure secured to the body member between the two flat sheets adjacent the bottom thereof rotatably mounting the leg member.

The individual leg portions of the leg member beneath the picture of the upper body of the runner are resistant to wind moving in the plane of the body member whereby the leg member is rotated on the axle structure by wind moving in the plane of the body member to produce the appearance of running by the runner.

The animated toy of the invention is completed by a support member extending from the body member and adapted to be secured between a window of a vehicle and the frame of the window on the window being raised whereby on movement of the automobile, air is caused to pass by the leg member to cause rotation thereof. The animated toy thus gives the impression of the runner running with the automobile.

BRIEF DESCRIPTION OF THE DRAWINGS

FIG. 1 is a side view of an automobile having the animated toy of the invention in use in combination therewith.

FIG. 2 is an enlarged partly perspective side view of the animated toy of the invention as secured to the car in FIG. 1.

DESCRIPTION OF THE PREFERRED EMBODIMENT

Figure 4:
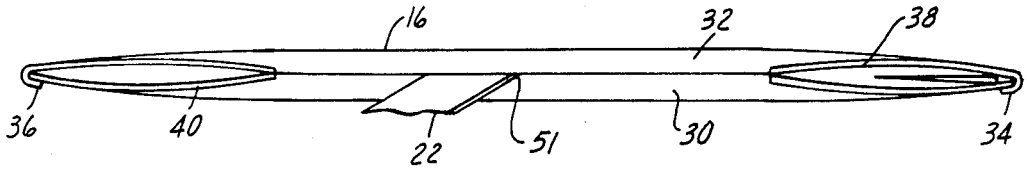
FIG. 4 is a top view of the animated toy illustrated in FIG. 3 taken in the direction of arrow 4 in FIG. 3.

The animated toy 10 of the invention is particularly suited for use in combination with an automobile 12. As shown in FIG. 1, the animated toy 10 is supported outside of the automobile 12 and the air 14 through which the automobile 12 passes provides motive force for the animated toy 10.

More specifically, as shown in FIG. 2, the animated toy 10 includes a body member 16, a leg member 18, axle structure 20 and support member 22. The leg member 18 is mounted for rotation about the axle structure 20 by air 14. Axle structure 20 is secured to the body member 16 and the leg member 18. Axle structure 20 and body member 16 and leg member 18 are supported by the support member 22 from the automobile 12.

More specifically, as shown best in FIGS. 2 through 7, the body member 16 is a flat sheet of cardboard or the like having the ends 24 and 26 which is folded centrally at 28 to provide two, juxtapositioned flat sheets or sides 30 and 32. The sides 30 and 32 are secured together by convenient means such as tabs 34 and 36 at the edges of side 32 having glue thereon or the like. Corners 38 and 40 are shaped as shown.

The corner 48 of the body member 16 is folded inward as shown in FIGS. 3,5,6 and 7 to provide a channel 50 for directing air onto the leg member 18.

Figure 3:
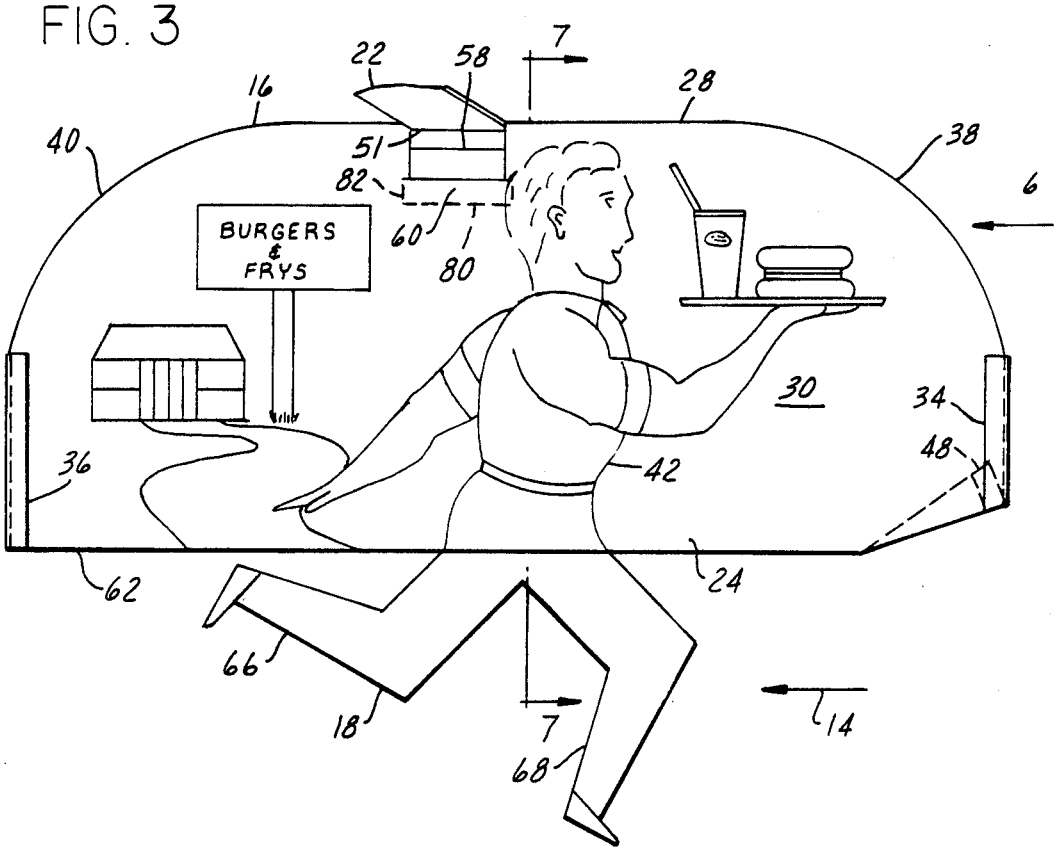
FIG. 3 is a view of the other side of the animated toy of the invention taken substantially in the direction of arrow 3 in FIG. 2.
Figure 5:
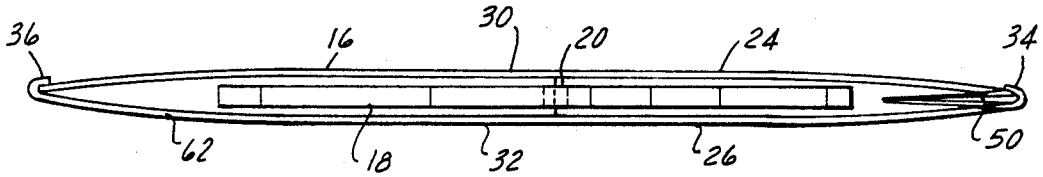
FIG. 5 is a bottom view of the animated toy illustrated in FIG. 3 taken in the direction of arrow 5 in FIG. 3.
Figure 6:
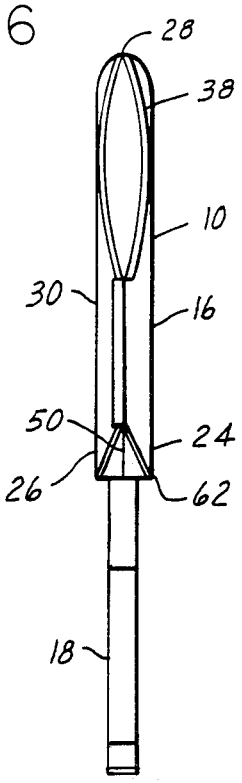
FIG. 6 is a front view of the animated toy illustrated in FIG. 3 taken in the direction of arrow 6 in FIG. 3.

A representation of the upper body 42 of a runner is provided on both the side 32 as shown in FIG. 2 and the side 32 as shown in FIG. 3 of the body member 16. The representation of the runner 42 includes the complete runner other than the legs of the runner. The runner 42 may be purely fanciful or may be any of the well known cartoon or trademark characters. The runner may of course be a representation of an actual person or something other than a person such as a tire.

Slots 58 and 60 as shown best in FIG. 3 may be provided in the body member 16 to permit securing of the support member 22 to the body member 16. Securing of the support member 22 to the body member 16 will be considered in more detail subsequently.

Body member 16 as shown may be constructed of cardboard or any material similar properties such as limited form memory. Appropriate materials may be plastic, thin metal or the like. It is desirable that the material from which the body member 16 is constructed have limited memory so that as the bottom thereof is spread apart to insert the axle structure 20 as shown best in FIG. 7, the sides 30 and 32 of the body member 16 tend to close the bottom 62 to thereby hold the axle structure 20 therebetween.

Figure 9:
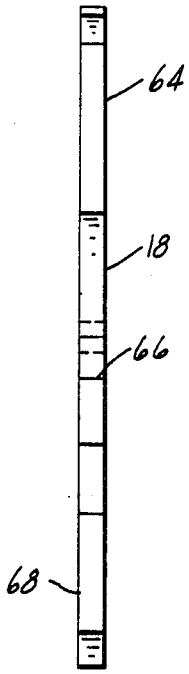
FIG. 9 is a back view of the leg member illustrated in FIG. 8 taken substantially in the direction of arrow 9 in FIG. 8.
Figure 8:
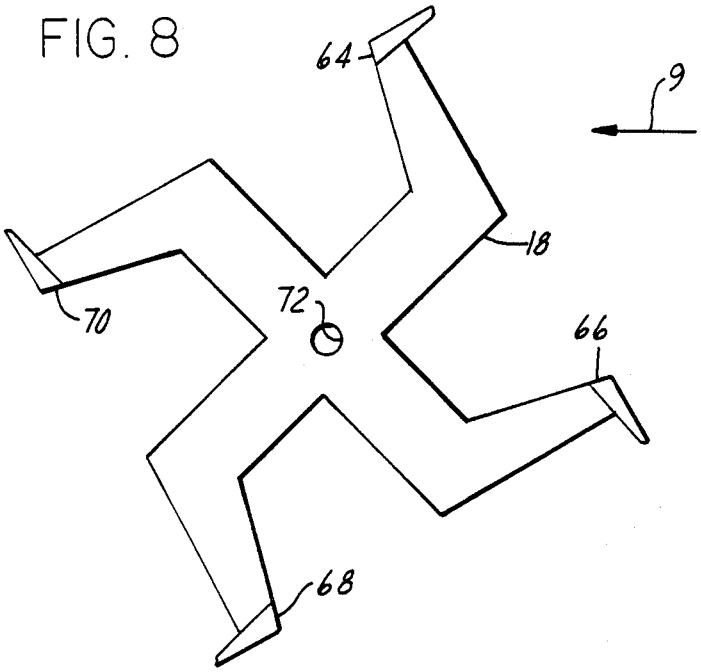
FIG. 8 is a side view of the leg member of the animated toy of FIGS. 1 through 7.

The leg member 18 is shown best in FIGS. 8 and 9. The leg member 18 as shown, includes four separate leg portions 64,66,68 and 70, angularly separated by 90°. The leg member 18 is provided with an opening 72 extending therethrough through which the axle structure 20 of the animated toy 10 extends as will be considered subsequently.

While the leg member 18 may be constructed of substantially any material, in the preferred embodiment shown, it is constructed of styrofoam cut into the shape shown in FIGS. 8 and 9. Any desired pictorial representation of legs, shoes and the like, may be placed on the styrofoam of the leg member 18 or may be printed on paper which is then secured to the leg member 18 as by means of an adhesive or the like.

Figure 7:
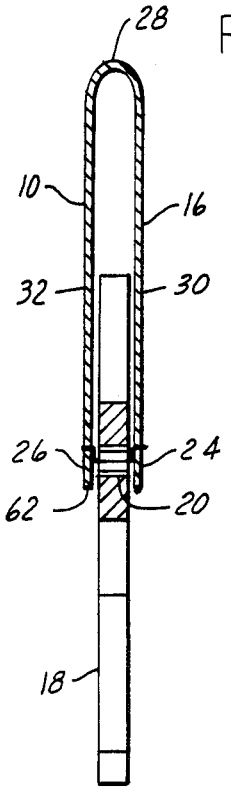
FIG. 7 is a cross section of the animated toy illustrated in FIG. 3 taken substantially on the line 7—7 in FIG. 3.
Figure 10:
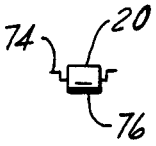
FIG. 10 is a front view of the axle structure of the animated toy of FIGS. 1 through 7 constructed in accordance with the invention.

The axle structure 20 as best shown in FIGS. 7 and 10, includes a wire 74 bent into a U-shape and secured at its opposite ends to the body member 16 adjacent the bottom thereof by convenient means such as small punctures in the sides 30 and 32 or the like. A portion of the straw 76 is mounted on the central portion of the wire 74 as shown best in FIG. 10 for receiving the leg member 18. The straw portion 76 extends through the opening 72 in the leg member 18. Thus, in operation, the leg member 18 and straw portion 76 rotate about the central portion of the wire 74 to provide the illusion of the FIG. 42 on the body member 16 running.

Support member 22 may be a substantially flat band having an L-shaped inner end 78 and an outer end 80 including tabs 82 extending from the opposite sides thereof. The end 80 of the support member 22 is secured to the body member 16 by the end 82 within the body member 16 extending through the slots 58 and 60 in the body member 16 so that the tabs 82 prevent accidental dislodgement of the support member 22 from the body member 16 as shown best in FIG. 3. If desired, the support member 22 may be mounted on the body member 16 by placing the end 78 through the slots 58 and 60 initially and then out of body member 16 through an opening 51 in the fold 28 of body member 16. As pointed out above, the end 78 of the support member 22 may be firmly held between the window 84 in the up position and the window frame 86 of the automobile 12.

In overall use of the animated toy 10 of the invention, the toy 10 constructed as set forth above is secured to the automobile 12 by opening the window 84 of the automobile 12 and placing the toy 10 outside of the automobile 12 with the end 78 of the support member 22 clamped between the window 84 and window frame 86 of the automobile 12 with the window 84 in a substantially closed position.

With the animated toy 10 so positioned and with the automobile 12 moving, the air 14 through which the automobile 12 moves impinges the leg member 18 on the leg parts 64,66,68 and 70 extending below the body member 16 of the toy 10 to cause the leg member 18 and straw portion 76 of the axle structure 20 to rotate on the wire portion 74 of the axle structure. The animated toy 10 thus gives the illusion of the runner 42 running with the automobile.

As pointed out above, the toy 10 as thus described and used, is particularly simple and therefore easy and inexpensive to manufacture. Further, the toy 10 as disclosed above and used as described is particularly animated and will change speeds with the speed of the automobile 12 to provide great interest for a child playing with the toy.

Further, the toy 10 may be utilized to advertise substantially any product. In particular, the runner may be any of a number of trademark caricatures or may have trademark goods in conjunction therewith such as trademark shoes, clothes and the like. The toy may then be used as a promotional item given to customers at little or not cost to entice the person using the toy to purchase certain items or frequent certain businesses such as fast good chains, and/or gasoline stations.

While one embodiment of the present invention has been considered in detail, it will be understood that other embodiments and modifications thereof are contemplated by the inventor. Thus, for example, the movable member in the animated toy may be a tire and the advertisement may be for a tire company on the body member 16. It is the intention to include all such modifications and embodiments as are defined by the appended claims within the scope of the invention.

I claim:

1. In combination, an automobile having at least one window therein which may be raised and lowered and an animated toy including a body part on which a representation of the upper body portion of a runner is depicted including two substantially flat portions with juxtapositioned surfaces having the top and two sides secured together and having a bottom, axle structure including a U-shaped wire member with end portions secured to the body member with the legs of the U abutting the flat portions at the bottom thereof and the bight of the U extending transversely and a straw portion sleeved over the central part of the U-shaped wire member, a leg member having a plural leg portions thereon constructed to provide resistance to wind created by movement of the automobile mounted for rotation on the straw portion of the axle structure with leg portions of the leg member extending below the representation of a runner on the body member whereby on rotation of the leg member the illusion of the runner running is provided and support means secured to the body member and pinched between the window and the frame for the window with the window closed to hold the animated toy in spaced relation to the automobile while the automobile is in motion.

2. An animated toy, comprising a body member having a picture of the upper body of a runner thereon which body member is a sheet folded centrally to form two generally parallel, flat, juxtapositioned sheet portions with the fold at the top and with the sides of the sheet portions secured together whereby the bottom may be opened to place a leg member partially within the folded sheet from the bottom thereof, a leg member including a plurality of leg portions, means mounting the leg member for visible rotation on the body member in substantially the normal position for legs on the upper body portion of the runner pictured on the body member including a U-shaped wire secured to the body member at the bottom thereof with the bight of the U forming an axle for said leg member and the legs of the U abutting the inner surfaces of said sheet portions, and means whereby the leg member is caused to rotate by air passing the leg member to provide the illusion of the pictured runner running.

3. Structure as set forth in claim 2, and further including means for supporting the body member with the leg member rotatably mounted thereon from an automobile.

4. Structure as set forth in claim 2, wherein the material from which the folded sheet is constructed has a limited shape memory whereby it tends to return to a flat folded member on release of the ends thereof after the bottom has been opened to insert the leg member.

5. Structure as set forth in claim 2, wherein the leg member includes four separate leg portions angularly spaced apart about a central opening 90° with respect to each other.

6. Structure as set forth in claim 2, wherein the means for mounting the leg member further includes a portion of a straw extending through the leg member and through which the central portion of the U-shaped wire extends.

* * * * *